US009016790B2

(12) United States Patent
Voyce, IV

(10) Patent No.: US 9,016,790 B2
(45) Date of Patent: Apr. 28, 2015

(54) CONVERTIBLE SEATING RECLINING CHAIR

(71) Applicant: William E. Voyce, IV, Silver City, NM (US)

(72) Inventor: William E. Voyce, IV, Silver City, NM (US)

( * ) Notice: Subject to any disclaimer, the term of this patent is extended or adjusted under 35 U.S.C. 154(b) by 91 days.

(21) Appl. No.: 13/573,772

(22) Filed: Oct. 4, 2012

(65) Prior Publication Data

US 2014/0097648 A1 Apr. 10, 2014

(51) Int. Cl.
*A47C 1/035* (2006.01)
*A47C 1/032* (2006.01)

(52) U.S. Cl.
CPC ..... *A47C 1/035* (2013.01)

(58) Field of Classification Search
USPC ..... 297/85 M, 354.13, 411.23, 340
See application file for complete search history.

(56) References Cited

U.S. PATENT DOCUMENTS

| | | | | |
|---|---|---|---|---|
| 1,936,973 | A * | 11/1933 | Switzer | 297/354.13 |
| 5,790,997 | A * | 8/1998 | Ruehl | 5/618 |
| 6,412,870 | B1 * | 7/2002 | Higgins et al. | 297/342 |
| 7,475,944 | B2 | 1/2009 | Griepentrog | |
| 7,600,817 | B2 * | 10/2009 | Kramer et al. | 297/362.13 |
| 8,262,163 | B2 * | 9/2012 | Wu | 297/343 |
| 2009/0315381 | A1 * | 12/2009 | Longnecker | 297/411.23 |
| 2012/0074751 | A1 * | 3/2012 | De La Garza et al. | 297/354.13 |

* cited by examiner

*Primary Examiner* — Milton Nelson, Jr.
(74) *Attorney, Agent, or Firm* — Brian D. Voyce

(57) ABSTRACT

The present invention relates to a convertible seating reclining chair. The chair comprises conventional elements such as a back frame, a seat frame, left and right support arms, and a reclining mechanism connected laterally between the support arms. The reclining mechanism has a stationary base frame, a back movement mechanism, and a seat movement mechanism. The seat movement mechanism and the back movement mechanism are dimensioned and configured to move, respectively, the seat frame and the back frame from their respective positions in the chair's upright seating position to their respective positions in the chair's fully horizontal, recumbent position. Such movement of the back frame and the seat frame occurs with the back frame seating surface at the lower end of the back frame being located substantially adjacent to the seat frame seating surface at the rear end of the seat frame.

12 Claims, 7 Drawing Sheets

CONVERTIBLE SEATING RECLINING CHAIR

BACKGROUND OF THE INVENTION (1) Field of the Invention

The present invention relates to a convertible seating reclining chair. The chair comprises the following conventional elements. A back frame has an upper end, a lower end, and a back frame seating surface. A seat frame has a front end, a rear end, and a seat frame seating surface. A left support arm has a front ground support surface, a rear ground support surface, and a left armrest support surface. A right support arm has a front ground support surface, a rear ground support surface, and a right armrest support surface. The chair also has a reclining mechanism connected laterally between the left support arm and the right support arm, and connected to the back frame and to the seat frame. The reclining mechanism has a stationary base frame, a back movement means, and a seat movement means. The back movement means is connected to the base frame and is dimensioned and configured for moving the back frame from an upright seating position to a fully horizontal or recumbent position. The seat movement means also is connected to the base frame, and is dimensioned and configured for moving the seat frame, from the upright seating position to the fully horizontal or recumbent position, the seat frame seating surface being downwardly tilting from the front end to the back end while in the seating position. The seat movement means and the back movement means are dimensioned and configured to move, respectively, the seat frame and the back frame from their respective positions in the chair's upright seating position to their respective positions in the chair's fully horizontal, recumbent position. Such movement of the back frame and the seat frame occurs with the back frame seating surface at the lower end of the back frame being located substantially adjacent to the seat frame seating surface at the rear end of the seat frame.

(2) Description of the Related Art, Including Information Disclosed Under 37 CFR 1.97 & 1.98

In providing a chair that can convert to a sleeping surface, the prior art is well illustrated by U.S. Pat. No. 7,475,944 to Griepentrog et alia.

In order to convert a chair from a seating position to a sleeping position, the Griepentrog reclining mechanism (as shown in FIGS. 8 to 10 of the '944 patent) requires that the seating surface (16 in '944) extend markedly beyond the horizontal plane of the back surface (18 in '944) while in the seating position. The reclining mechanism also has a seat rotation member (65 and 66 in '944) that extends downward from the back surface pivot point (70 in '944). The seating surface support member (28 in '944) is connected to the seat rotation member such that rotation of the back downwardly to a horizontal position simultaneously raises the rear or back portion seating surface support member to a horizontal position, pivoting the seating surface support member on the front edge of that member.

In order to achieve a fully recumbent, horizontal position, the prior art creates a substantial hole (or void) in the seating cushion. (See 104 and 16 in FIG. 2 of '944). Moreover, in order to maintain back cushion to seat cushion contact during rotation, not only must the seat cushion be substantially longer than the surface required by the seating position and have the void, it must also have a back cushion having an expanding support material located at the bottom or lower end of the cushion. In essence, the cushion to cushion contact relies upon an elastomeric quality to the lower end of the back cushion, and not the travel paths of the cushions as they respectively pivot. Finally, the prior art requires that the chair occupant shift their position on the seating surface during rotation in order to maintain full lumbar support during rotation.

BRIEF SUMMARY OF THE INVENTION

The present invention relates to a convertible seating reclining chair (10). The chair comprises the following conventional elements.

A back frame (20) has an upper end (22), a lower end (24), and a back frame seating surface (26).

A seat frame (30) has a front end (32), a rear end (34), and a seat frame seating surface (36).

A left support arm (40) has a front support member (42), a rear support member (44), and a left armrest support surface (46).

A right support arm (50) has a front support member (52), a rear support member (54), and a right armrest support surface (56).

The chair also has a reclining mechanism (60) connected laterally between the left support arm and the right support arm, and connected to the back frame and to the seat frame. The reclining mechanism has a stationary base frame, a back movement means, and a seat movement means.

The back movement means is connected to the base frame and to the back frame. The back movement means is dimensioned and configured for moving the back frame from an upright seating position (as shown in FIGS. 1 and 3) to a recumbent position (as shown in FIGS. 2 and 4).

The seat movement means is also connected to the base frame and to the seat frame. The seat movement means is dimensioned and configured for moving the seat frame from the upright seating position to the recumbent position, the seat frame seating surface being downwardly tilting from the front end to the back end while in the upright seating position. The back movement means and the seat movement means can be dimensioned and configured so as to move independently of each other, or alternatively, can be interconnected so as to move together, as described in more detail below.

The seat movement means and the back movement means are also dimensioned and configured to move, respectively, the seat frame and the back frame about the base frame from the upright seating position to the fully horizontal, recumbent position while locating the back frame seating surface at the lower end of the back frame (24) substantially adjacent to the seat frame seating surface at the back end of the seat frame (34) (as shown in FIGS. 3 and 4). Such positioning occurs throughout the range of motion of the seat frame and the back frame.

The present invention can also incorporate a footrest (100). The footrest is movable between a retracted position (as shown in FIG. 3) and an extended position (as shown in FIG. 4). When fully extended, the footrest is generally coplanar with the seating surface.

The present invention can also have a base frame that is pivotably mounted to a Trendelenburg frame and a Trendelenburg frame actuator (112). The pivoting connection (114) between the stationary base frame and the Trendelenburg frame, a conventional depressed horizontal movement means, allows for movement between a horizontal orientation (when the chair is in the recumbent position) and a Trendelenburg orientation in which the head of the occupant is lowered relative to the occupant's heart. The Trendelenburg actuator allows for releaseably locking the Trendelenburg frame in either the raised or lowered positions.

A first object of the invention is to provide for a chair that can convert from an ergonomically supportive seating position to a recumbent position, while maintaining ergonomic occupant support during the conversion movement.

A second object of the invention to provide an article of seating furniture which includes a back reclining arrangement that enables the back to be moved to varying angular positions, and which provides synchronous raising of the seat when the back is lowered, and synchronous lowering of the seat with the back is raised.

A third object of the invention to provide an article of seating furniture which incorporates a unique frame configuration for providing reclining movement of the back and for synchronously moving the seat with the back.

A fourth object of the invention is to provide an article of seating furniture which includes a footrest that can be moved between extended and retracted positions, and which can be selectively maintained in one or more intermediate positions between the extended and retracted positions.

A fifth object of the invention is to provide an article of seating furniture in which a footrest positioning mechanism provides positive positioning of the footrest in predetermined angular orientations relative to the seat.

A sixth object of the invention is to provide an article of seating furniture which can be converted to a bed configuration in which the seat and the back are generally coplanar, and which can be moved to a Trendelenburg position in which the head area of the back is below the foot area of the seat.

A seventh object of the invention is to provide an article of seating furniture incorporating a uniquely configured actuator for providing selective operation of certain movable components of the article of seating furniture, such as the reclining back mounting mechanism and the Trendelenburg feature.

An eighth object of the invention is to provide an article of seating furniture in which the actuator provides a flush mount construction, so as not to have protruding components and not to detract from the overall aesthetic appearance of the article of seating furniture.

A ninth object of the present invention is that one can adjust the height of the support surfaces so as to account for the support loading variance between the seating support and the back support.

A tenth object of the present invention is that one can provide the above functionality, provide for a recumbent surface over two meters in length, while being able have a width of less than one meter that can fit within conventional three foot door openings.

DETAILED DESCRIPTION OF THE INVENTION

Figure 1:
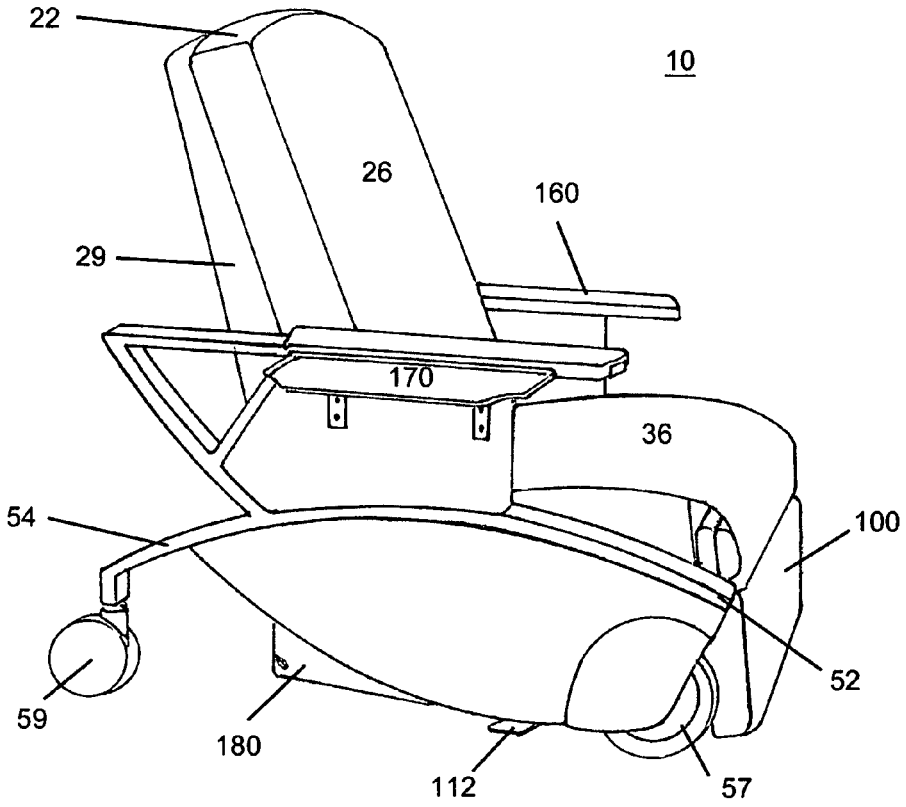
FIG. 1 is a perspective view of the present invention as upholstered in a seating position.
Figure 2:
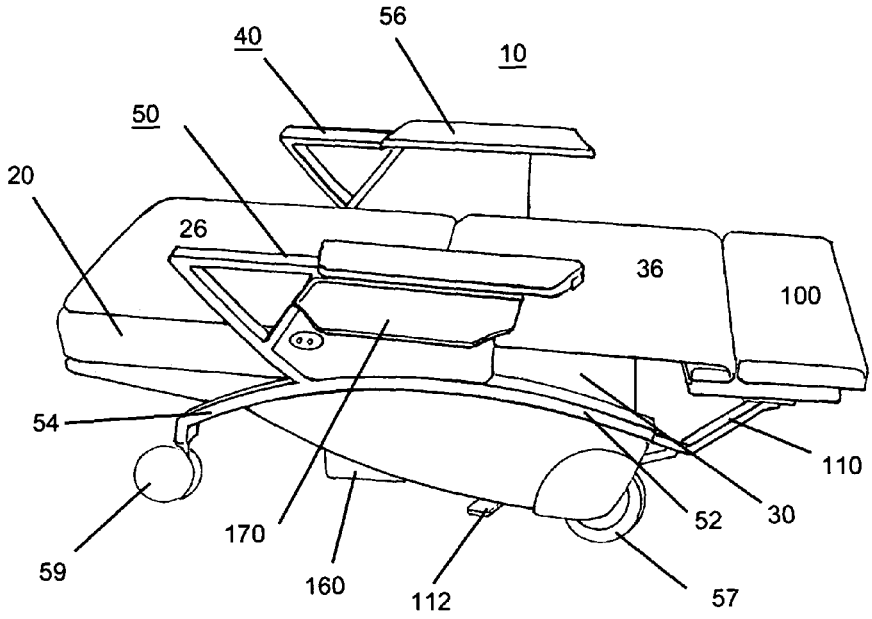
FIG. 2 is a perspective view of the present invention as upholstered in a recumbent position.

In preferred embodiments, the present invention can have many variants. For example, the seat frame (30) comprises the combination of a planar seat frame base (31), a bagged coil suspension member (33) located adjacent the planar seat frame base, and a seat frame base covering (35), the combination of which provides the seat frame seating surface (36). This back frame provides an occupant support that is suitable not just for napping, but also for prolonged sleeping. Even more preferably, the bagged coil seat suspension member can be covered with a layer of high density seating foam (37).

Likewise, the back frame (20) comprises the combination of a planar back frame base (21), a bagged coil suspension member (23) located adjacent the planar back frame base, and a back frame base covering (25), the combination of which provides the back frame seating surface (26). Again, this seat frame provides an occupant support that is suitable not just for napping, but for prolonged sleeping. Even more preferably, the bagged coil back suspension member can be covered with a layer of high density seating foam (27).

In essence, the seat frame and the back frame can provide mattress-like support while maintaining in the present invention the ability to be convertible from a conventional mattress orientation to a seating orientation.

Figure 3:
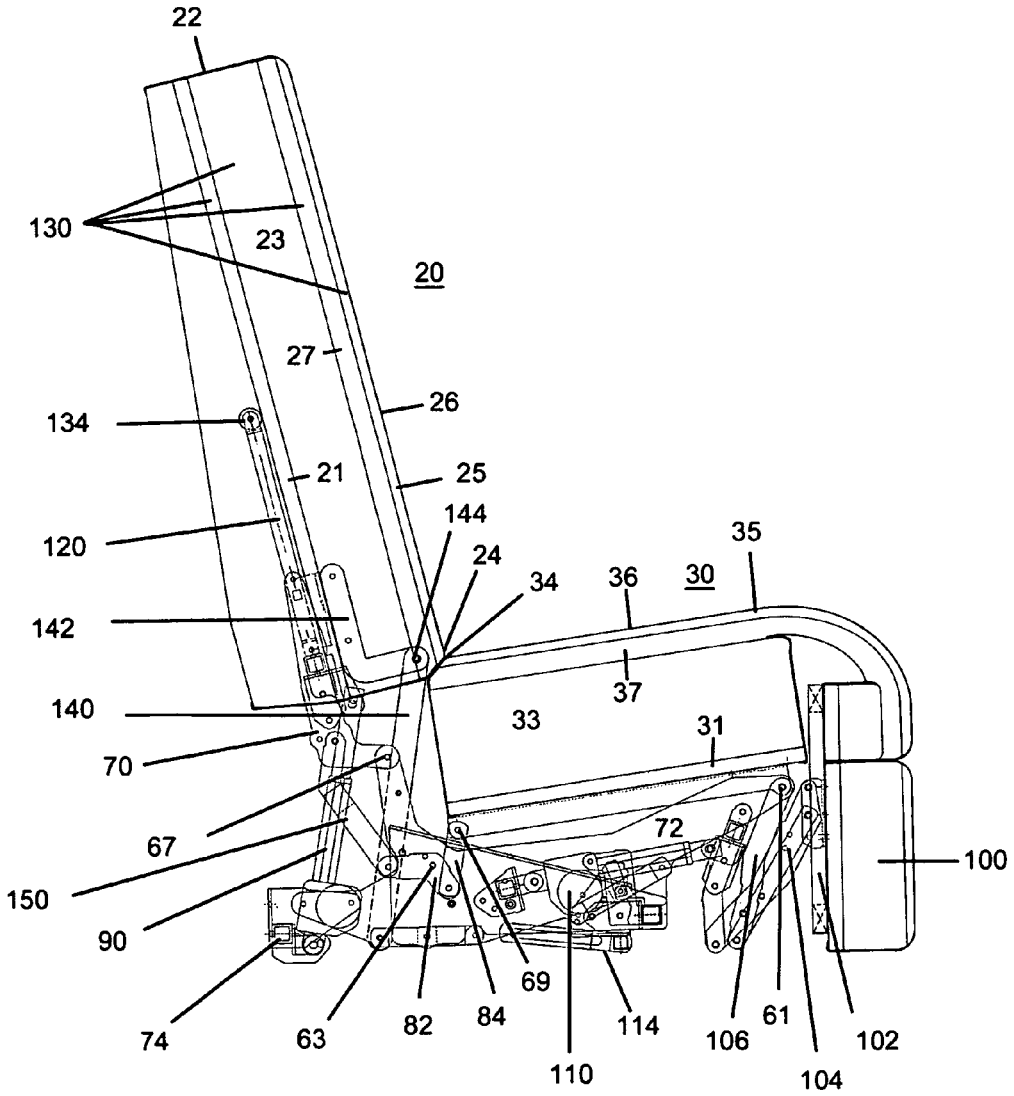
FIG. 3 is a side elevation view of a preferred embodiment of the present invention illustrating the recliner mechanism with the leg extension retracted, the back frame in a seating position, and the seat frame in a seating position, as well as illustrating the cushioned seat frame and cushioned back frame.
Figure 4:
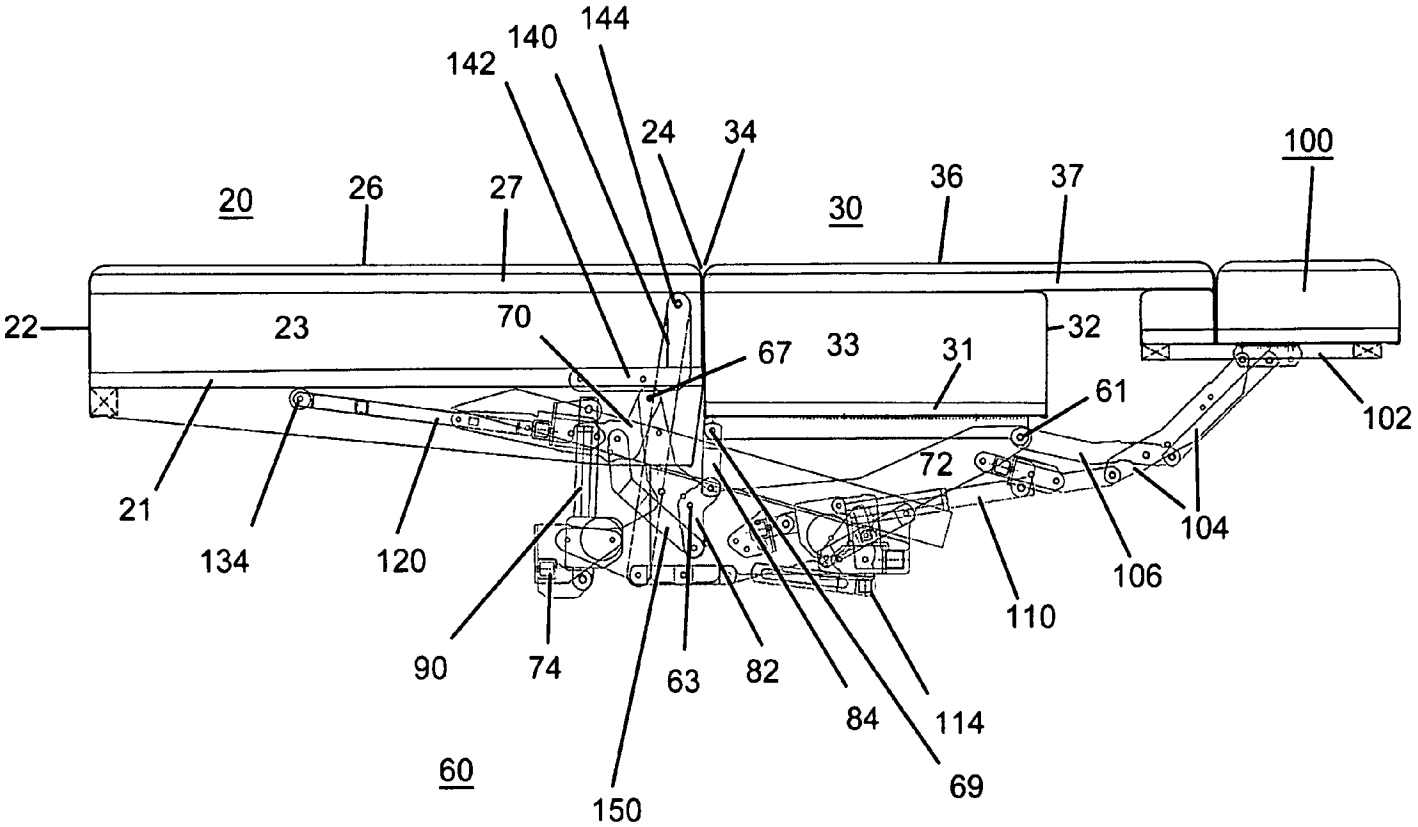
FIG. 4 is a side elevation view of a preferred embodiment of the present invention illustrating the recliner mechanism with the leg extension extended, the back frame in a recumbent position, and the seat frame in a recumbent position, as well as illustrating the cushioned seat frame and cushioned back frame.
Figure 5:
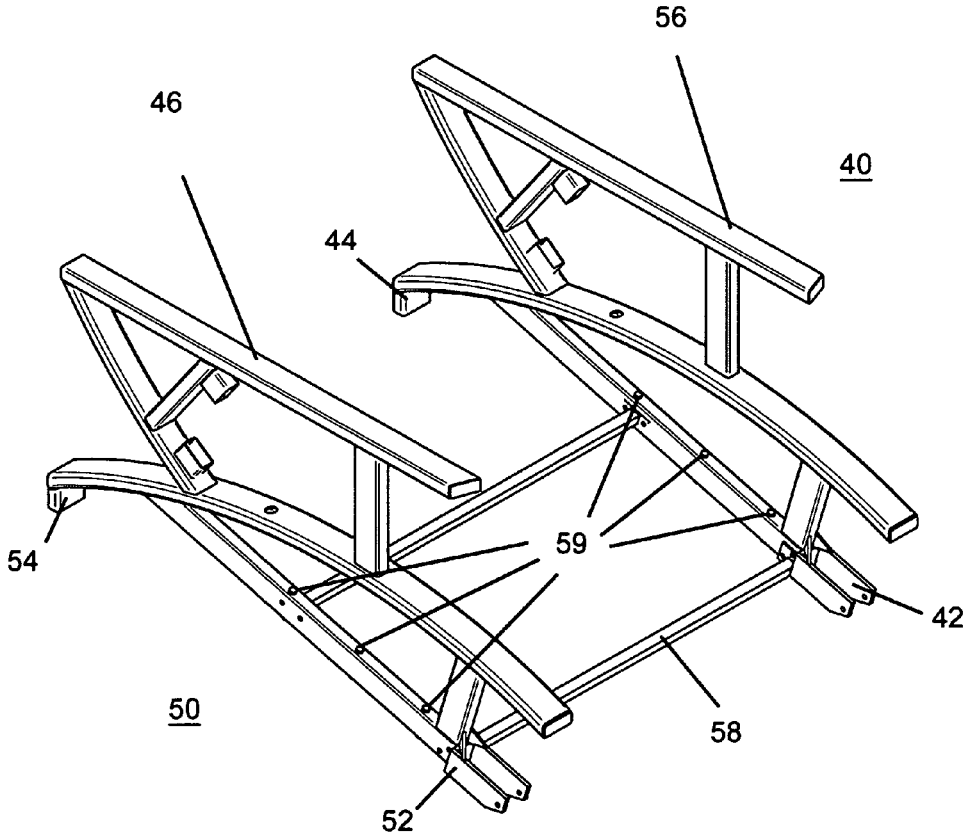
FIG. 5 is a perspective view of a preferred embodiment of the present invention illustrating the arm chassis.

A preferred embodiment of the recliner mechanism (60) of the present invention can be seen in FIGS. 3 and 4. The mechanism is dimensioned and configured so as to maintain a coplanar relationship between the back support surface (26) and the seat support surface (36), while allowing two different heights in the seat frame and the back frame. For example, one can use a four inch high, pocketed coil support suspension (23) covered by a layer of high density foam (27) in the back support cushion and a six inch high, pocketed coil support suspension (33) covered by a layer of high density foam (37) in the seat support cushion. One advantage of the present invention is that one can adjust the height of the support surfaces so as to account for the support loading variance between the seat frame and the back frame while each is in either the recumbent position or the seating position.

The reclining mechanism has a stationary base frame comprised of a pair of vertical frame supports (72) connected by at least one lateral member (74). The seat frame (30) is pivotably mounted at the front end of the base frame (61), the seat movement means (comprising elements 82 and 84) is also pivotably mounted on the base frame (at point 63). The seat movement means is dimensioned and configured to connect to the seat frame (at pivot point 69) so as to raise or lower the rear of the seat frame (34) between a coplanar recumbent position and a downwardly tilting seating position. As seen in FIGS. 3 and 4, this seat movement means can also comprise a seat movement to back movement interconnecting linkage (150) that allows for the seat frame to be moved in combination with the movement of the back frame. In a more preferred embodiment, the seat actuating means also comprises a motor driven linear actuator (90). This actuator can be driven by a rechargeable battery (180) stored on the base frame.

In a preferred embodiment, the back movement means also comprises two cooperative elements. The first cooperative element is a sliding back frame support member (120) pivotably mounted at the rear end of the base frame (67). This member is mounted on the base frame at a point different in location (rearward and lower) from the pivot point (144) of a second cooperative element, a rotatable back frame member (142). (For the purposes of the present invention, "sliding" refers to the relative movement between two rotating elements with different points of rotation. While each element may travel in a rotation path, the motion of one element with respect to the other element contains a relative non-rotational aspect, referred to herein as "sliding".)

Figure 7:
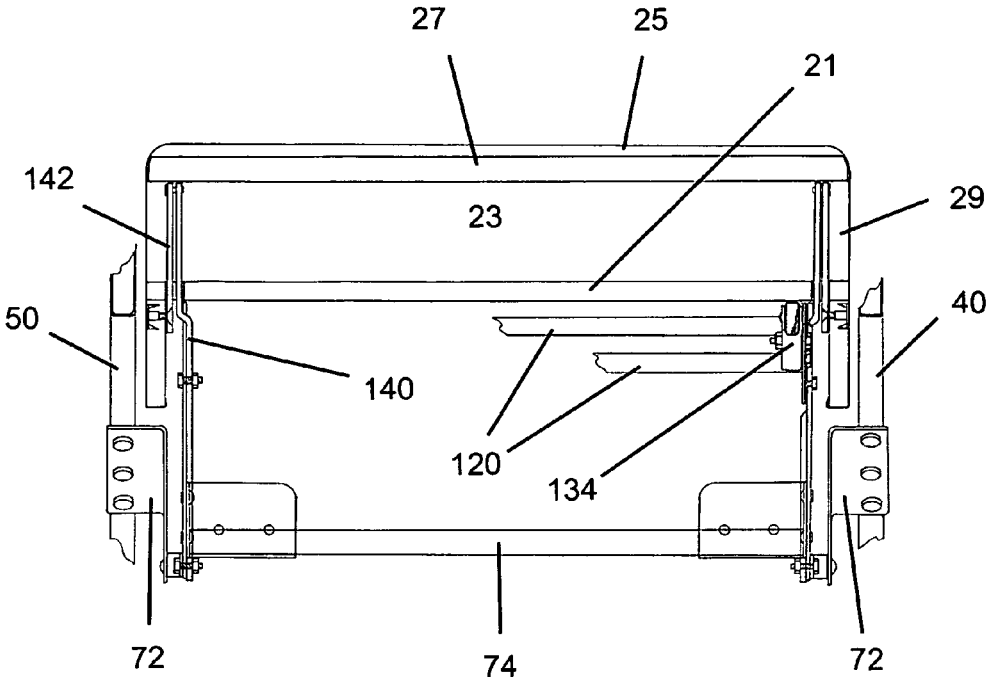
FIG. 7 is a cross sectional view of a detail of the preferred embodiment of the present invention illustrating the sliding back frame and the fixed back frame.

The sliding back frame support member is located so as to support the back frame (130), which is connected to the rotatable back frame member, throughout the range of motion of the rotatable back frame member, as seen in FIG. 7. Thus, in moving from the seating position to the recumbent position, the sliding back frame support member pivot point moves longitudinally with respect to the rotatable back frame member, while supporting the back frame. The end of the sliding back frame support member (at element 134) in the recumbent position (FIG. 4) is substantially closer to the upper end of the back frame (22) than when in the seating position (as shown in FIG. 3). The sliding back frame support and/or the rotatable back frame also may have a friction reduction means, such as a roller wheel (134) that reduces the force needed for such relative longitudinal movement.

In this preferred embodiment, the back frame (shown as a combination of the elements 21, 23, 25, and 27) attaches to the rotatable back frame member, which, in turn, connects to a fixed back frame pivot point member (140) which, in turn, connects to the rear of the base frame. The rotatable back frame member (142) is pivotably mounted to the upper portion of the back frame pivot point member. The rotatable back frame member is dimensioned and configured so as to allow for the thickness of the back frame.

The combination of the back frame pivot point member and the rotatable back frame member fixes the lower edge of the back frame (24) with respect to the rear edge of the seat frame (34), even as the sliding back frame support member follows a different rotational path dictated by its different pivot point. In operation, the present invention allows support of the rotatable back frame by the sliding back frame support throughout the range of motion of both elements.

The present invention also allows for non-mechanical and non-muscular powering of chair movement. A motor driven, back linear actuating means (90) can be pivotably connected to the base frame and to the sliding back frame support member. As the linear actuator extends from a retracted position (the chair recumbent position), the sliding back frame support member rotates in an upward path to the chair seating position.

As seen in FIG. 3, the back movement means can also function to drive the movement of the seat movement means. By means of an interconnecting linkage (150), seat support movement occurs in combination with back support movement. Thus, a single linear actuating means (90) can drive the back movement means and the seat movement means.

In a more preferred embodiment, the present invention also comprises the rotatable back frame having back frame guide members (29) attached thereto. As can be seen in FIG. 7 (wherein the right side of the FIGURE shows a cutaway of the back frame pivot point member (140), revealing the relationship between elements), the back frame guide member extends downwardly and is located to the outside of the sliding back frame support member (120). The back frame guide members are dimensioned and configured so as to prevent lateral movement of the back frame relative to the reclining mechanism. Alternatively, these guide members can also be incorporated into the sliding back frame support member. For example, the sliding back support member can be dimensioned and configured with elements that extend upwardly such that the back frame slips between the guide members. Such an arrangement would continue to allow movement of the sliding back support member in the longitudinal direction while constraining lateral or sideways movement of the back frame.

Also in a preferred embodiment, the recliner mechanism has a leg extension actuating means for operating the footrest (100) from an extended position to a retracted position. As can be seen in FIGS. 3 and 4, this leg extension actuating means comprises a leg extension footrest support (102) pivotably connected to a series of conventional scissor linkages (104). In turn, the end footrest linkage (106) is pivotably connected to the vertical base frame support (72) and also connected to a leg extension actuator, such as a motor driven linear actuator (110). As with conventional recliner footrests, the linkages and actuator connection points are dimensioned and configured such that the actuator can move the leg extension support through the linkages from a vertical orientation to a horizontal orientation. Moreover, the seat frame seating surface can be connected to the footrest by means of a continuous covering. As shown in FIG. 3, the covering can be flexible and function as a continuous "waterfall" on to the footrest.

For ease of construction, the present invention may have an arm chassis comprising the elements of the left support arm (40), the right support arm (50) and a plurality of transverse chassis members (58) that connect the two support arms. These transverse chassis members are dimensioned and configured so that the support arms, once connected to the chassis members, form the arm chassis into which the reclining mechanism can be directed and fastened during assembly of the convertible reclining chair. In other words, once the arm chassis is formed by connecting the transverse members to the support arms, the support arms are held in a fixed relationship in which the connection points of the reclining mechanism match up to the connection points for the support arms. Thus, the arm chassis simplifies assembly of the present invention by allowing the assembler to slip the reclining mechanism onto the arm chassis for fastening without further adjustment or assembly jigging.

The front support members and the rear support members of the respective left and right support arms should be dimensioned and configured such that the distance between the front ground support surfaces and the rear ground support surfaces (respectively elements 57 and 59) of each arm provide a stable platform for supporting an occupant while the present invention is in the recumbent position. As can be seen from the FIGURES, it is preferred that the front ground support surfaces be forward of the seat frame pivot point, while the rear ground support surfaces are to the rear of the back frame pivot point.

As also can be seen from the FIGURES, these ground support surfaces can also comprise conventional casters, providing the ability to move the present invention easily while occupied. In addition, the left and right armrest support surfaces can be dimensioned and configured to function not only as an armrest, while the present invention is in a seating position, but also has a bedrail while it is in the recumbent position.

Figure 6:
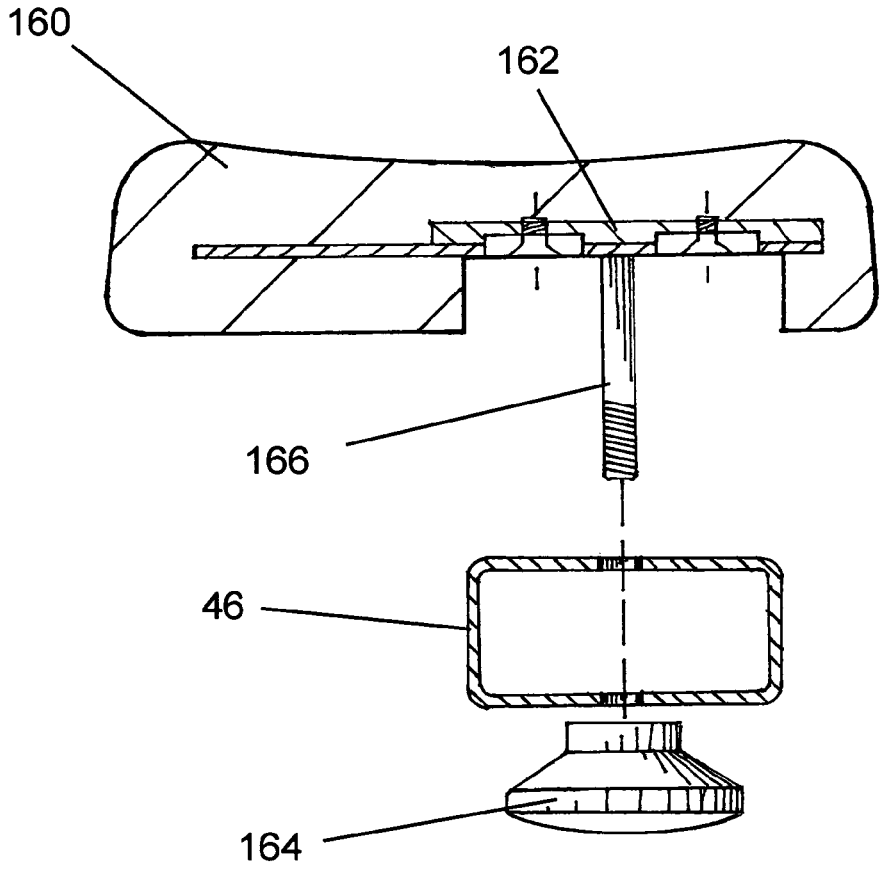
FIG. 6 is a cross sectional view of a detail of a preferred embodiment of the present invention illustrating the removable armrest support surface.

Finally, the present invention allows for removable armrest support members (160) that extend laterally beyond the dimensions of the left or right armrest support surface to which they are respectively attached. In a preferred embodiment wherein the support arm surfaces (46 and 56) contain steel, each arm support also comprises a magnetic securing means (162) positioned between the removable arm support member and that portion of the armrest support surface from which the removable arm support member is removed. Alternatively or in combination, the removable armrest support member can be removably secured to the armrest support surface by a mechanical means, such as the threaded knob (164) and threaded rod (166), also shown in FIG. 6. In yet another example, one can provide for the armrest support member to slide longitudinally onto the respective armrest support surface in a gripping relationship and to have a spring leaf member on the underside of the armrest support member that engages a detent in a vertical surface of the respective armrest support surface.

If desired, folding tables (170) can be attached to the arms as well. Preferably, they are affixed such that in the folded position they do not protrude beyond the width of the respective arm rest support members. Even equipped with the optional tables, embodiments of the present invention can easily support a person two meters in length and about 85 centimeters in width.

The ordinarily skilled artisan can appreciate that the present invention can incorporate any number of the preferred features described above.

All publications or unpublished patent applications mentioned herein are hereby incorporated by reference thereto.

Other embodiments of the present invention are not presented here which are obvious to those of ordinary skill in the art, now or during the term of any patent issuing from this patent specification, and thus, are within the spirit and scope of the present invention.

I claim:

1. A convertible reclining chair comprising:

a) a back frame having an upper end, a lower end, and a back frame seating surface;

b) a seat frame having a front end, a rear end, and a seat frame seating surface, the seat frame seating surface being downwardly tilting from the front end to the back end while in a seating position;

c) a left support arm having a front ground support member, a rear ground support member, and a left armrest support surface;

d) a right support arm having a front ground support member, a rear ground support member, and a right armrest support surface; and e) a reclining mechanism connected laterally between the left support arm and the right support arm, connected to the back frame, and connected to the seat frame, the recliner mechanism having a stationary base frame, a back movement means connected to the stationary base frame, the back movement means being dimensioned and configured for moving the back frame from an upright seating position to a recumbent position, and a seat movement means connected to the stationary base frame, the seat movement means being dimensioned and configured for moving the seat frame from an upright seating position to a recumbent position;

wherein the back movement means and the seat movement means are dimensioned and configured to move, each element respectively, the seat frame and the back frame from the upright seating position to the recumbent position while locating the back frame seating surface at the lower end of the back frame substantially adjacent to the seat frame seating surface at the rear end of the seat frame.

2. The convertible reclining chair of claim 1 wherein the seat frame is pivotally attached to the stationary base frame at the front end of the seat frame and the back frame is pivotally attached to the stationary base frame at the lower end of the back frame seating surface.

3. The convertible reclining chair of claim 1 also having a freestanding arm chassis which comprises the left support arm, the right support arm, and a plurality of transverse chassis members that connect the two support arms, the transverse chassis members being dimensioned and configured so that the support arms being connected to the chassis members forms an arm chassis into which the reclining mechanism can be directed and fastened during an assembly of the convertible reclining chair.

4. The convertible reclining chair of claim 1 also having a footrest pivotally attached directly to the front end of the seat frame wherein the footrest can pivot from a vertical position to a horizontal position, and also wherein the reclining mechanism is connected to the footrest so as to provide for movement from the vertical position to the horizontal position.

5. The convertible reclining chair of claim 1 wherein the back movement means and the seat movement means are linked so as to move at the same time.

6. The convertible reclining chair of claim 1 also having a depressed horizontal movement means that is connected to the reclining mechanism, whereby if the seat frame and the back frame are in the recumbent position, the combination of the back frame seating surface and the seat frame seating surface forming a continuous planar surface, the seat frame and the base frame can be tilted simultaneously to a depressed horizontal position, the upper end of the back frame being lower in height above a reclining chair support surface than the lower end of the seat frame.

7. The convertible reclining chair of claim 1 wherein the reclining mechanism has at least one linear actuator providing the force for movement of either the seat movement means or the back movement means.

8. The convertible reclining chair of claim 1 wherein each arm support also comprises a hand-removable arm support member.

9. The convertible reclining chair of claim 8 wherein each arm support also comprises a magnetic securing means positioned between the hand-removable arm support member and that portion of the arm support from which the hand-removable arm support member is removed.

10. The convertible reclining chair of claim 1 wherein the back movement means also comprises a sliding back frame support member, the sliding back frame support member being pivotably mounted and connected to the base frame at a first pivot point, and a rotatable back frame member, the rotatable back frame member being pivotably and connected to the base frame at a second pivot different in location from the first pivot point and connected to the back frame, wherein the sliding back frame support member supports the back frame throughout the range of motion of the rotatable back frame member.

11. The convertible reclining chair of claim 10 wherein the back frame also comprises a back frame guide member that is dimensioned and configured to prevent lateral movement of the back frame relative to the sliding back frame support member.

12. The convertible reclining chair of claim 11 wherein the back movement means and the seat movement means are linked so as to move at the same time.

* * * * *